US005550422A

United States Patent [19]

Sulcs et al.

[11] Patent Number: 5,550,422

[45] Date of Patent: Aug. 27, 1996

[54] HIGH INTENSITY ARC DISCHARGE LAMP HAVING CLIP MEMBER TO SECURE BASE TO OUTER LAMP ENVELOPE

[75] Inventors: Juris Sulcs, Chagrin Falls; Raymond J. Noe, Highland Heights, both of Ohio

[73] Assignee: Venture Lighting International, Inc., Solon, Ohio

[21] Appl. No.: 360,577

[22] Filed: Dec. 21, 1994

[51] Int. Cl.[6] ..... H01J 5/48; H01J 1/88; H01K 1/46

[52] U.S. Cl. ..... 313/25; 313/318.04; 313/318.09; 439/615

[58] Field of Search ..... 313/25, 318.01, 313/318.04, 318.09; 439/220, 375, 602, 611, 613, 612, 614, 615, 616

[56] References Cited

U.S. PATENT DOCUMENTS

| | | | |
|---|---|---|---|
| 4,007,397 | 2/1977 | Lake | 315/51 |
| 4,496,874 | 1/1985 | Sanders et al. | 439/616 X |
| 4,581,557 | 4/1986 | Johnson | 313/25 |
| 4,647,809 | 3/1987 | Blaisdell et al. | 313/318.04 |
| 5,055,740 | 10/1991 | Sulcs | 313/634 |
| 5,241,238 | 8/1993 | Westlund et al. | 313/25 |

*Primary Examiner*—Sandra L. O'Shea
*Assistant Examiner*—Jay M. Patidar
*Attorney, Agent, or Firm*—John F. McDevitt

[57] ABSTRACT

A modified base construction for a high intensity arc discharge lamp is described enabling a single piece screw type conductive base member to be directly secured to the outer lamp envelope. The simplified base construction employs a conductive clip physically attached to the outer lamp envelope which provides a locking engagement between the assembled lamp parts.

17 Claims, 5 Drawing Sheets

HIGH INTENSITY ARC DISCHARGE LAMP HAVING CLIP MEMBER TO SECURE BASE TO OUTER LAMP ENVELOPE

BACKGROUND OF THE INVENTION

This invention relates generally to an improved base construction for various type high intensity arc discharge lamps and more particularly to providing simpler means for permanently securing a screw type base member directly to the outer lamp envelope.

High intensity arc discharge lamps of various types are now globally employed as a source of highly efficient white and colored illumination in both indoor and outdoor applications. Both mercury vapor and metal halide types of said lamps conventionally employ a tubular arc tube of light transmissive vitreous material as an inner light source which is hermetically sealed within an outer vitreous lamp envelope. The arc tube comprises a hermetically sealed envelope, which can be quartz glass having thermionic electrodes at opposite ends in pinch seal regions and further contains a gaseous discharge medium which includes mercury. The gaseous discharge medium can further contain alkali metal and/or alkaline earth metal additives to form an amalgam with mercury. Addition of the latter additives in metal halide lamps has been found to enhance the color of light output as well as increase its efficiency. The general construction of such type lamps is further disclosed in U.S. Pat. Nos. 4,007,397; 4,581,557; and 5,055,740 to include the conventional use of a screw type conductive base member for operation in existing socket fixtures.

A common construction in prior art lamps of this type includes an inner hollow shell member affixed to the outer lamp envelope which is threaded into an outer shell member. A pair of lamp inlead conductors emerging from the outer lamp envelope are terminated by connection to the outer metal shell member with one of said inlead conductors being electrically isolated therefrom in the customary manner. Understandably such requirement for a multi-shell base assembly complicates lamp manufacture as well as increases lamp cost. A need to carefully control the physical tolerances in both size and shape of the individual shell members in such base assembly for the high speed lamp manufacture now being carried out represents still another problem associated with the prior art base construction.

Accordingly, one object of the present invention is to provide a more simple base construction for high intensity arc discharge lamps.

It is another object of the present invention to provide a base construction for high intensity arc discharge lamps which is less subject to control of physical tolerances between the individual base components.

A still further object of the present invention is to reduce material costs for a base construction in such type lamps.

Still another object of the present invention is to provide a relatively simple modification in otherwise conventional lamp manufacture needed for the basing of a high intensity arc discharge lamp.

These and still further object of the present invention will become more apparent upon considering the following detailed description for the present invention.

SUMMARY OF THE INVENTION

A modified base construction is now provided for a high intensity arc discharge lamp which enables a single piece screw type conductive base member to be directly secured to the outer lamp envelope by means of a conductive clip physically attached to the outer lamp envelope. Suitable clip means for this purpose employs a general physical configuration, such as a U-shaped member, enabling direct physical attachment to the customary threaded base end of the outer lamp envelope while further including at least one outwardly projecting tang element to physically engage the conductive base member when joined thereto, Subsequent assembly of a customary screw type base shell to the outer lamp envelope permanently anchors the base shell in place due to frictional forces occasioned between the tang element of the clip member and inner surface of the hollow base shell. Fabrication of the clip member with conventional conductive metals, such as copper, brass or iron alloys, is preferred to withstand elevated operating temperatures at the base end of the outer lamp envelope which can exceed 200° C. or more.

Conventional discharge lamp construction further includes a pair of inlead conductors emerging from the threaded end of the outer lamp envelope for customary termination at the conductive base member. The molded threads of the conventional lamp envelope generally further include one or more longitudinally extending surface depressions therein to secure one of the inlead conductors in place for electrical connection to the base member and with the remaining inlead conductor being electrically isolated therefrom in the customary manner. Accordingly, one of such existing surface depressions in such conventional lamp envelope can further provide a suitable location for physical attachment of the clip member thereat and in a manner enabling the projecting tang element or elements of said clip member to protrude slightly beyond the molded threads of the lamp envelope. Attaching the base shell to the mating threads of the outer lamp envelope completes assembly of the herein modified discharge lamp construction. The emerging inlead conductor being electrically connected directly to the base shell in said lamp embodiment can also be anchored to the clip member for lamp manufacture or assembly, if so desired. For example, one or more openings can be provided in the illustrated U-shaped clip member having the tang construction to accommodate passage of said inlead conductor therethrough. Actual joinder of said inlead conductor itself to the clip member by such means as soldering and the like is also contemplated.

Adoption of the presently improved base construction employing clip means to reliably secure a single piece screw type conductive base member to the threaded outer lamp envelope has benefits for still other high intensity arc discharge lamp configurations. For example, in a different conventional lamp configuration there is employed an inner threaded conductive base shell mechanically crimped to molded dimples at the base end of an unthreaded outer lamp envelope when an outer threaded conductive base shell having mating threads is screwed thereto. Employment of the presently improved base construction understandably eliminates need for such inner base shell as a cost saving while further simplifying the lamp manufacture. A still different conventional arc discharge lamp configuration employs a single piece screw type conductive base member affixed to the threaded end of an outer lamp envelope which includes longitudinally extending surface depressions in which one of the emerging inlead conductors is held in place with a solder deposit that further avoids unscrewing of the base member from the lamp envelope. Adoption of the present base member construction can possibly eliminate any such need for soldering in order to prevent partial or complete separation of the joined lamp components.

DETAILED DESCRIPTION OF THE PREFERRED EMBODIMENTS

Figure 1:
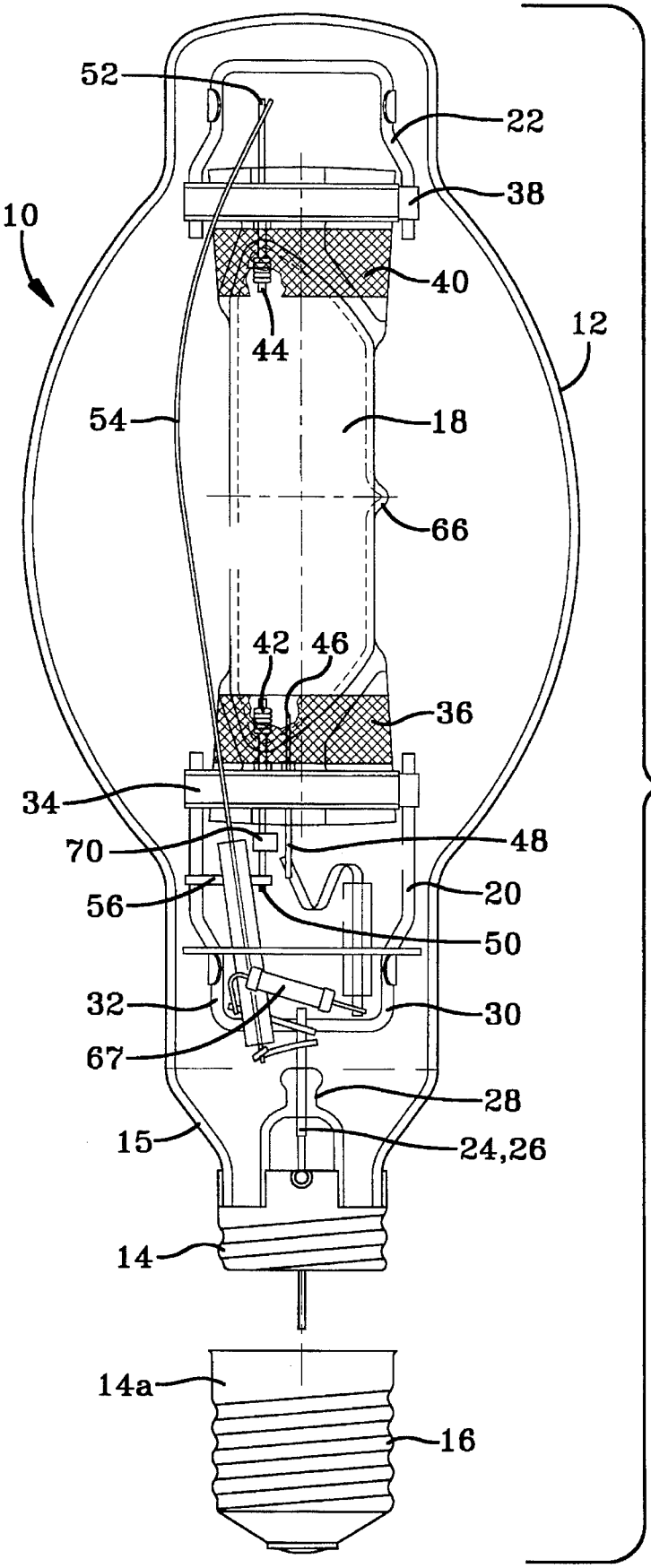
FIG-1 PRIOR ART
FIG. 1 is a side view depicting a prior art metal halide arc discharge lamp.

FIG. 1 is a cross sectional side view depicting a representative prior art metal halide discharge lamp 10 employing a two-part base member construction. More particularly the lamp comprises an outer vitreous envelope 12 shown partially secured to a two-part screw-in type conductive base assembly 14 and 14*a* at an unthreaded end. Inner conductive base shell 14 is shown physically attached to the unthreaded end 15 of the lamp envelope while outer conductive base shell 14*a* has mating threads 16 for further attachment to the inner base shell when screwed together. An arc tube assembly 18 is physically suspended within the outer envelope 12 by means of a two-part metal mount frame 20 and 22 which is electrically connected in part to lamp terminal means provided in outer base member 14*a*. In said regard such electrical connection is provided with first inlead conductors 24 and 26 extending outward from a conventional reentrant stem 28 to a pair of metal support rods or posts 30 and 32 forming the lower half 20 of the mount frame. Upper half 22 in said mount frame remains electrically isolated or insulated from the lamp terminal means other than when connected thereto during lamp operation by means of the arc discharge (not shown). Lower mount frame 20 includes a clamp 34 secured to bottom pinch seal region 36 of the arc tube member 18 while a similar clamp 38 is provided in the upper frame 22 and secured to upper pinch seal region 40 of the arc tube member as a structural means for its physical support. Arc tube member 18 includes spaced apart principal discharge electrodes 42 and 44 and a starting electrode 46 along with a suitable gaseous discharge medium including mercury and a metal halide (not shown). As herein shown, all discharge electrodes 42, 44 and 46 are individually connected to second inlead conductors 48, 50 and 52 at the respective pinch seal regions of the arc tube via thin refractory metal foil elements additionally located thereat. Still further electrical interconnection between the second inlead conductors 48, 50 and 52 and the first inlead conductors 24 and 26 is provided in the illustrated lamp embodiment. Inlead conductor 52 is connected to inlead conductor 26 with a curved wire element 54 whereas remaining inlead conductors 48 and 50 are separately connected to inlead conductors 24 and 26, respectively, with conductive metal strips 56 affixed to support rod 32 which is also connected to the latter inlead conductors. Arc tube 18 still further includes a conventional exhaust tip-off 66 disposed intermediate the discharge electrodes.

The herein illustrated prior art lamp embodiment is operated with external ballast means which can still further include housing some of the operating circuitry along with still other operating components within the outer envelope 12 of the lamp construction. For example, the depicted lamp embodiment includes gettering means (not shown) provided in outer envelope 12 to remove gases such as oxygen from undesirably oxidizing the inner lamp components. Additionally, there can be included starting resistor means 68 within the outer envelope which forms a part of the lamp operating circuitry. The lamp is enabled by such operating circuit means to ionize vapor formed within the selected gaseous discharge medium in order to produce an arc discharge between the principal discharge electrodes 42 and 44 providing the output illumination. Initial ionization in the lamp occurs between starting electrode 46 and principal electrodes 42 with a hi-metallic switch element 70 operating to terminate energization of the starting electrode when an arc discharge is established between both principal discharge electrodes.

Figure 3:
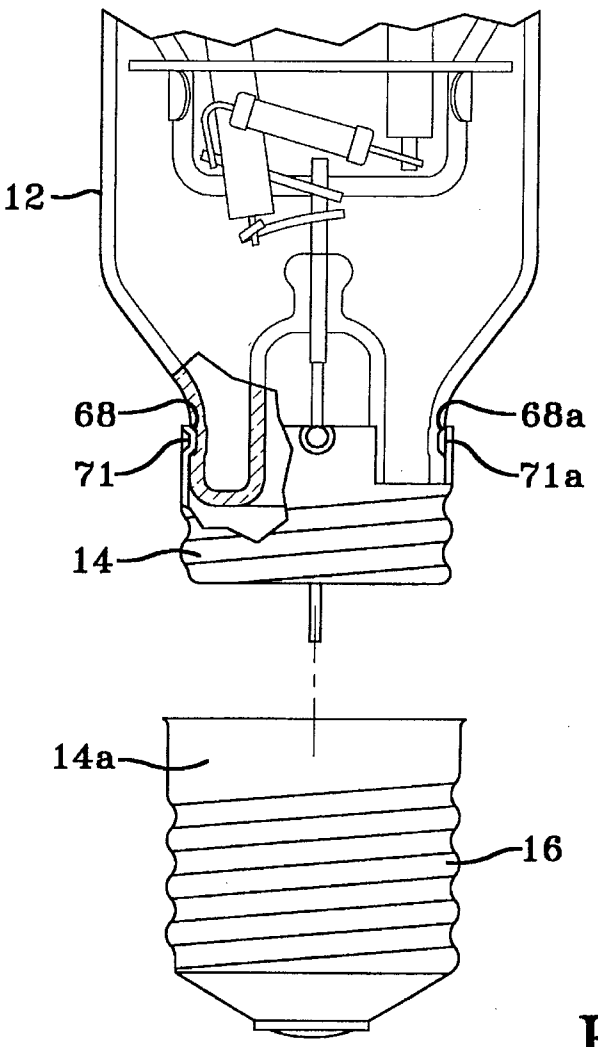
FIG-3 PRIOR ART
FIG. 3 is another side view of the base construction employed in the FIG. 1 lamp further depicting the manner of its assembly together.
Figure 2:
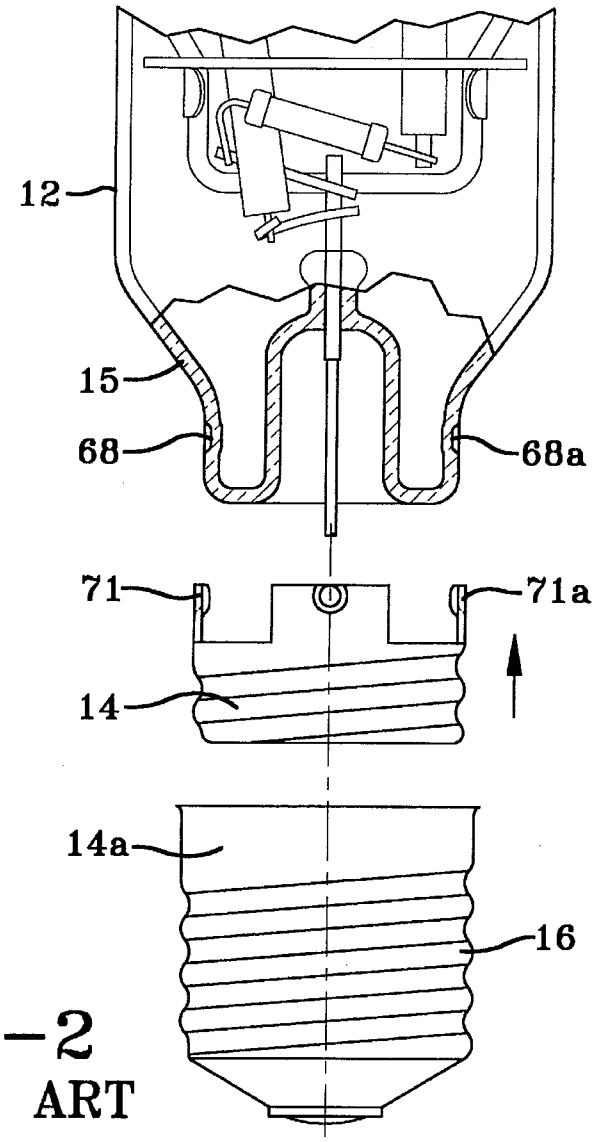
FIG-2 PRIOR ART
FIG. 2 is a side view of the base construction employed in the FIG. 1 lamp.

FIG. 2 provides a still more detailed side view of the prior art base assembly 14 and 14*a* employed in FIG. 1. Accordingly, the same numerals employed in FIG. 1 are retained in the present drawing to identify common components of said construction. Said base construction includes molded dimples or depressions 68 and 68*a* at the unthreaded base end 15 of outer lamp envelope 12 for physical attachment of inner base shell 14 thereto. Projecting tab elements 71 and 71*a* are provided at one end of the inner base shell as a means for doing so. Outer base shell member 14*a* is thereafter screwed into said inner base shell member 14 by means of its mating thread surface 16. A still further description of said prior art base assembly is depicted in FIG. 3. As therein shown, inner base shell 14 has already been secured to outer lamp envelope 12 in the forgoing manner with outer base shell 14*a* still remaining to be threaded by means of its mating threads 16 onto said inner base shell employing rotation provided with conventional automated lamp manufacturing equipment.

Figure 4:
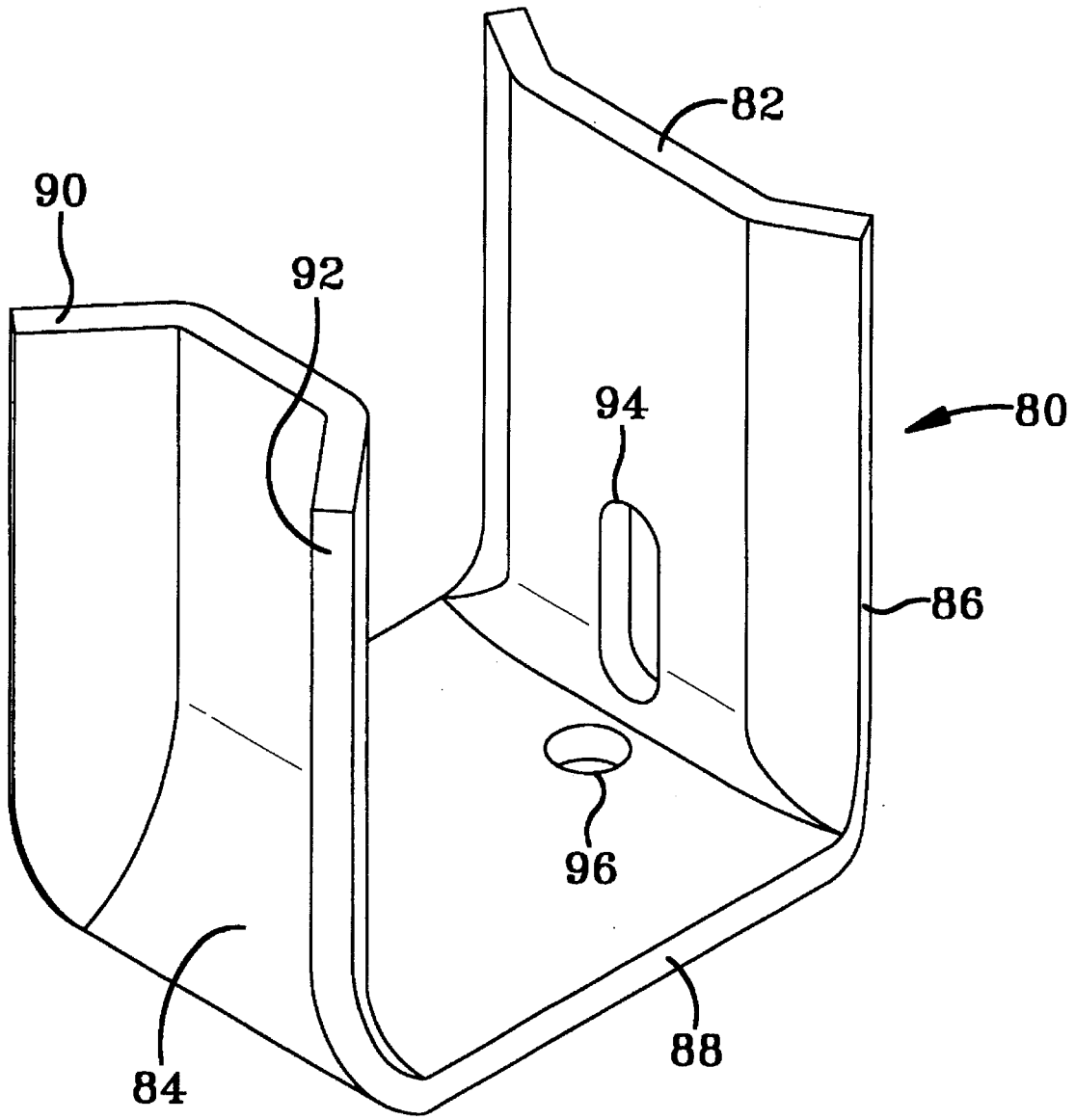
FIG. 4 is a perspective view of a representative clip means employed according to the present invention.

FIG. 4 is a perspective view depicting a representative clip means 80 for use in the presently improved lamp base construction. As can be seen, such clip means comprises a single metal U-shaped member 82 having spaced apart open ended leg elements 84 and 86 which are joined together at the opposite end with a connecting strip 88 to enable its physical attachment to the base end of a suitable outer lamp envelope (not shown) as more fully described hereinafter. Leg element 84 is formed to include a pair of outwardly projecting tang elements 90 and 92 to provide the means for frictional engagement with a suitable conductive base member (not shown) after being physically attached to the outer lamp envelope. Cooperating openings 94 and 96 are also provided in the clip member which enable an inlead conductor (not shown) emerging from the outer lamp envelope to be secured in place for subsequent termination at the conductive base member. In so doing, the herein illustrated clip member is physically attached to the base end of the outer lamp envelope with leg element 82 facing inwardly for initial passage of the emerging inlead conductor through opening 94 and continued passage of said inlead conductor through opening 96 for final joinder to the conductive base member. As previously indicated, joinder of the inlead conductor to the conductive base member in such manner, such as by soldering and the like, produces a desired electrical connection there-between.

Figure 5:
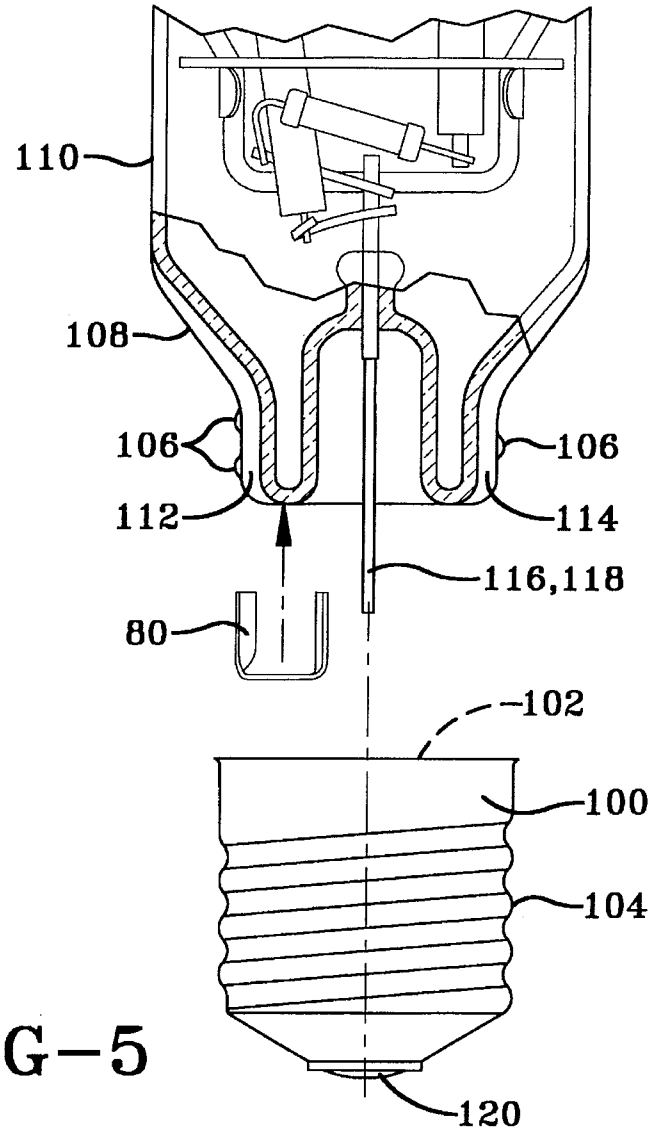
FIG. 5 is a side view for a representative arc discharge lamp base construction employing the clip means of FIG. 4.

In FIG. 5, a side view is shown of a representative arc discharge lamp base construction employing the clip means of FIG. 4. Accordingly, the depicted base construction utilizes a screw type conductive base shell 100 having an inner hollow opening 102 provided with a threaded surface 104 to be physically joined to mating threads 106 molded into the base end 108 of a vitreous outer lamp envelope 210 suitable for such discharge lamp. While not depicted in the present drawing, such discharge lamp can be of the same metal halide type previously described in FIG. 1 to include an inner arc tube of vitreous light transmissive material having discharge electrodes being sealed at opposite ends of a central cavity in pinch seal regions. The molded threads 106 of the depicted lamp envelope 110 further include a pair of longitudinally extending surface depressions 112 and 114 which participate in affixing-the clip member 80 to the outer lamp envelope in the above described manner. The pair of inlead conductors 116 and 118 emerging from said lamp envelope provide desired electrical interconnection between the inner arc tube (not shown) and the conductive base shell in the same manner also previously pointed out in the FIG. 1 embodiment. In such manner, inlead conductor 116 is secured to clip member 80 for electrical termination with the conductive base shell whereas remaining inlead conductor 118 is electrically isolated from said base shell upon termination at an insulated terminal 120 customarily provided in said base shell.

Figure 6:
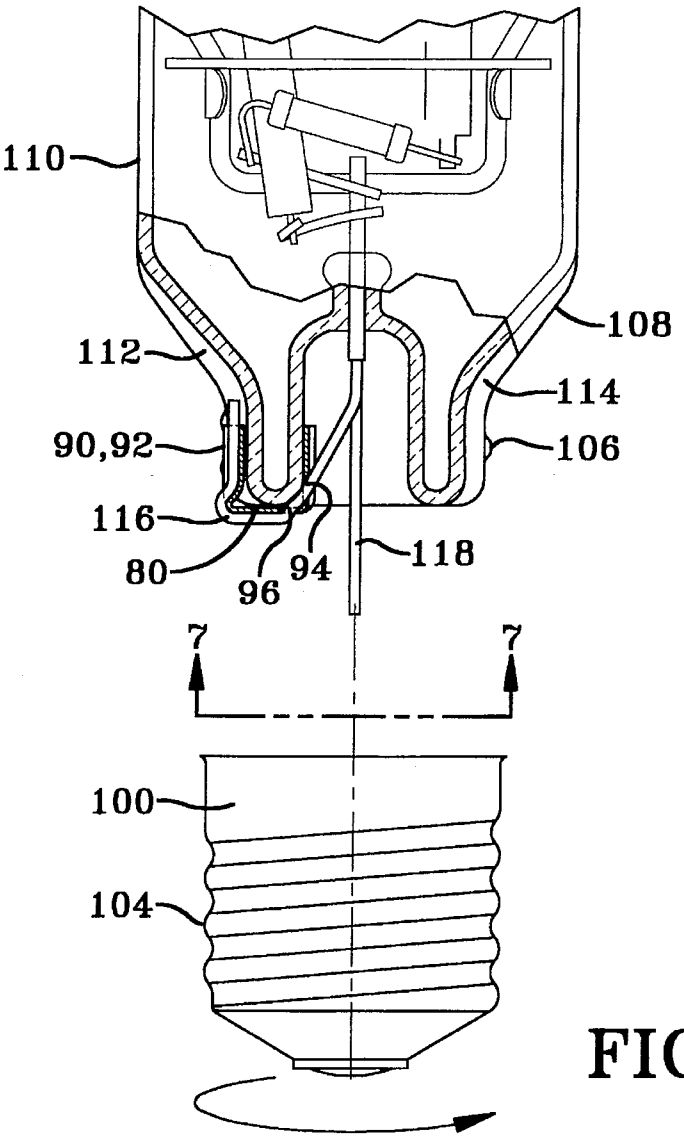
FIG. 6 is another side view of the FIG. 5 base construction depicting-the manner of assembly together.
Figure 7:
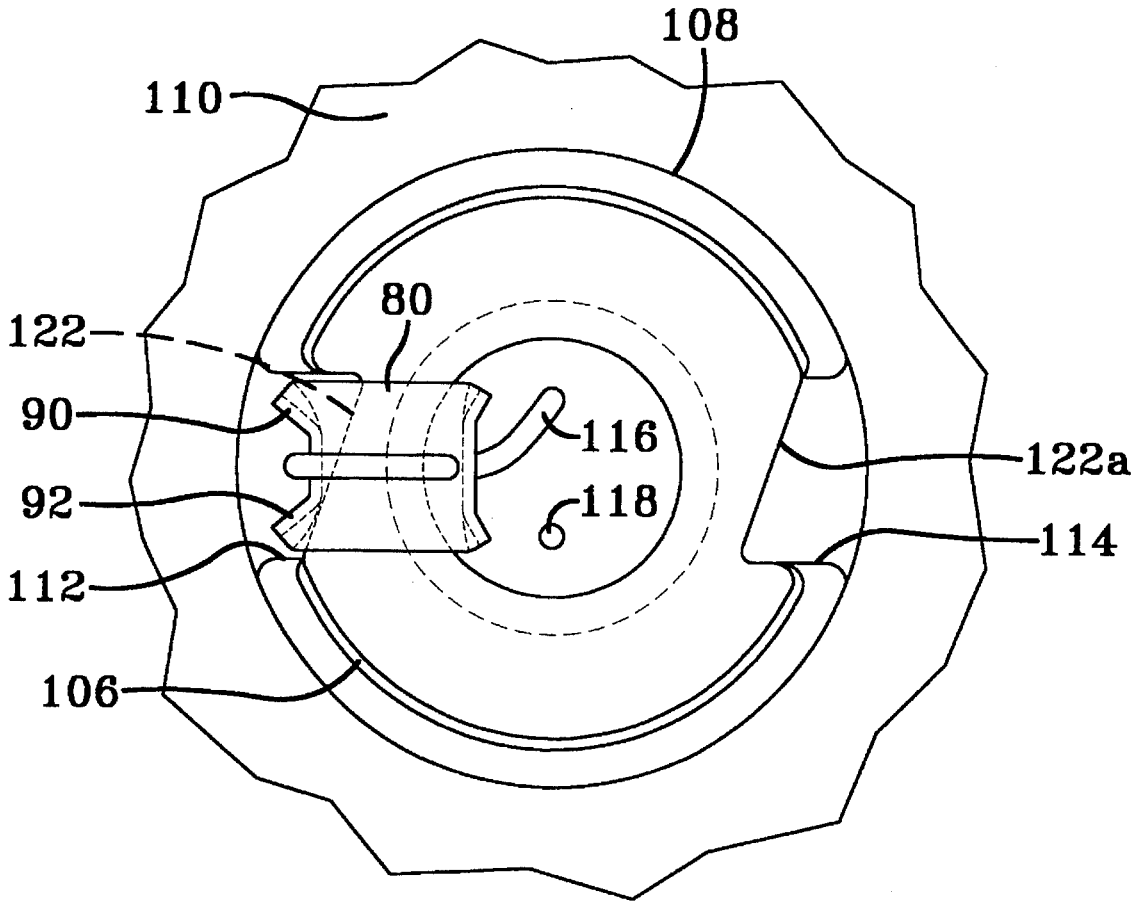
FIG. 7 is a cross sectional view of the FIG. 6 base construction depicting representative surface depressions in the threaded end of the outer lamp envelope for physically attaching the FIG. 4 clip means thereto.

FIG. 6 provides a still more detailed side view for the FIG, 5 base construction further depicting the manner for physically joining inlead conductor 116 to clip member 80 and thereafter physically attaching said clip member to the outer lamp envelope 110. It can be seen that said inlead conductor first proceeds through the openings 94 and 96 provided in the FIG. 4 clip member for passage to the inner side wall of base shell 100. It can further be seen in the present drawing, that clip member 80 and the physically attached inlead conductor 116 are then inserted into surface depression 112 at the base end 108 of the lamp envelope 110. The depicted partial assembly further positions tang elements 90 and 92 of the clip member to be facing outwardly of the lamp envelope for final frictional engagement with the inner side wall of base shell 100 when physically secured to the lamp envelope. Final assembly of the depicted base construction in the foregoing manner requires only rotary attachment of the base shell to the molded threads 106 provided on the lamp envelope which again can be provided with conventional automated lamp manufacturing equipment, In FIG. 7 there is shown a longitudinal sectional view taken through lines 7—7 in FIG. 6 to more fully depict representative surface depressions molded into the base end 108 of lamp envelope 110 for suitable attachment of the clip member 80 during lamp manufacture. Both surface depressions 112 and 114 employ a ramp configuration 122 and **122*a* to facilitate easy entry of the clip member thereinto after having the inlead conductor 116 first secured to said clip member. As can also be seen in the present drawing, such placement of the clip member in surface depression 112 enables at least one of the outwardly facing tang elements 90 and 92 to protrude slightly beyond the circumferential thread elements 106 provided in the illustrated lamp envelope. Upon simply threading the previously illustrated base shell over the projecting tang elements a sufficient frictional force is generated therebetween so as to effectively prevent any subsequent separation of the assembled lamp base construction. Further having the clip member lodged in a surface depression which terminates with the depicted slanting slope (ramp elements 122 and 122*a***) has also been found to aid in resisting detachment of the assembled base member.

It will be apparent from the foregoing description that a generally improved means has been provided for the base construction of various type high intensity arc discharge lamps, including both mercury vapor and metal halide type lamps. It is contemplated that modifications can be made in the specific lamp configurations than herein illustrated, however, without departing from the spirit and scope of the present invention. For example, these lamps may employ other already known lamp outer envelope shapes and sizes, inner arc tube constructions, specialized ballasting circuitry, and still other lamp variations. Accordingly, it is intended to limit the present invention only by the scope of the appended claims.

What we claim and desire to secure by Letters Patent of the United States is:

1. Anchoring means to secure a screw type conductive member having an inner hollow opening when physically joined to mating threads provided in an outer vitreous envelope of a high intensity arc discharge lamp which further employs an arc tube physically suspended within said outer vitreous envelope by means of a conductive metal mount frame, said anchoring means comprising a single conductive clip member physically separate and distinct from said conductive metal frame while physically engaging the mating threads of said outer vitreous envelope, said single conductive clip member having at least one outwardly projecting tang element for further frictional engagement with the inner hollow opening in the conductive base member.

2. The anchoring means of claim 1 wherein the conductive clip member is metal.

3. The anchoring means of claim 1 wherein the conductive clip member includes multiple projecting tang elements.

4. The anchoring means of claim 1 wherein the conductive clip member comprises a U-shaped member having multiple tang elements.

5. The anchoring means of claim 4 wherein the multiple tang elements project outwardly from one leg of said U-shaped member.

6. The anchoring means of claim 5 which further includes an opening to accommodate passage of a lamp inlead conductor therethrough.

7. A high intensity arc discharge lamp comprising:

(a) an outer light transmissive vitreous envelope having molded threads at one end, (b) an inner hollow arc tube of vitreous light transmissive material having discharge electrodes being sealed at opposite ends of a central cavity in pinch seal regions, said arc tube being physically suspended within said outer vitreous envelope by means of a conductive metal mount frame, (c) a conductive screw type base shell having an inner hollow opening which is physically joined to the molded threads of the outer vitreous envelope, and (d) a single conductive clip member physically separate and distinct from said conductive metal mount frame and physically attached to the molded threads of said outer vitreous envelope, said single conductive clip member having at least one outwardly projecting tang element for frictional engagement with the hollow opening in the conductive screw type base shell.

8. The lamp of claim 7 wherein the conductive clip member is metal.

9. The lamp of claim 7 wherein the conductive clip member includes multiple projecting tang elements.

10. The lamp of claim 7 wherein inlead conductors electrically connected to the arc tube emerge from the outer vitreous envelope for termination with the conductive base shell.

11. The lamp of claim 10 wherein first inlead conductors emerging from the outer vitreous envelope are individually electrically connected at one end to second inlead conductors extending outwardly from the arc tube.

12. A metal halide arc discharge lamp comprising:

(a) an outer light transmissive vitreous envelope having molded threads at one end and first inlead conductors projecting from said end, (b) an inner hollow arc tube of vitreous light transmissive material having discharge electrodes being sealed at opposite ends of a central cavity in pinch seal regions, the discharge electrodes being electrically connected to second inlead conductors extending outwardly from the arc tube and being individually electrically connected at the outer end to the first inlead conductors, the arc tube further containing a gaseous discharge medium which includes mercury and metal halide while further being physically suspended within said outer vitreous envelope by means of a conductive metal mount frame, (c) a conductive screw type base member having an inner hollow opening which is physically joined to the molded threads of the outer vitreous envelope while further having the first inlead conductors terminated thereto, and (d) a single conductive clip member physically separate and distinct from said conductive metal mount frame and physically attached to the molded threads of said outer vitreous envelope having at least one outwardly projecting tang element for frictional engagement with the hollow opening in the conductive screw type base member.

13. The lamp of claim 12 wherein the conductive clip member is metal.

14. The lamp of claim 12 wherein the conductive clip member includes multiple projecting tang elements.

15. The lamp of claim 12 wherein the arc tube is quartz glass.

16. The lamp of claim 12 wherein the discharge electrodes further include a starting electrode.

17. A metal halide arc discharge lamp comprising:

(a) an outer light transmissive vitreous envelope having molded threads at one end which includes longitudinally extending surface depressions therein terminating in a slanted slope and first inlead conductors projecting from said envelope end, (b) an inner hollow arc tube of vitreous light transmissive material having discharge electrodes to include a starting electrode being sealed at opposite ends of a central cavity in pinch seal regions, the discharge electrodes being electrically connected along with the starting electrode to second inlead conductors expending outwardly from the arc tube and being individually electrically connected at the outer end to the first inlead conductors, the arc tube further containing a gaseous discharge medium which includes mercury and a metal halide while further being physically suspended within said outer vitreous envelope by means of a conductive metal mount frame, (c) a conductive screw type base member having an inner hollow opening which is physically joined to the molded threads of the outer vitreous envelope while further having the first inlead conductors terminated thereto, and (d) a single conductive clip member physically separate and distinct from said conductive metal mount frame and physically disposed in one of said surface depressions provided in the molded threads of said outer vitreous envelope, the conductive clip member having at least one outwardly projecting tang element for frictional engagement with the hollow opening in the conductive screw type base member.

* * * * *